US006205012B1

(12) United States Patent
Lear

(10) Patent No.: US 6,205,012 B1
(45) Date of Patent: Mar. 20, 2001

(54) APPARATUS FOR ALTERING THE MAGNETIC STATE OF A PERMANENT MAGNET

(75) Inventor: Mervyn Frederick Lear, Bristol (GB)

(73) Assignee: Redcliffe Magtronics Limited, Bristol (GB)

( * ) Notice: Subject to any disclaimer, the term of this patent is extended or adjusted under 35 U.S.C. 154(b) by 0 days.

(21) Appl. No.: 09/331,868

(22) PCT Filed: Dec. 31, 1997

(86) PCT No.: PCT/GB97/03554

§ 371 Date: Aug. 4, 1999

§ 102(e) Date: Aug. 4, 1999

(87) PCT Pub. No.: WO98/29883

PCT Pub. Date: Jul. 9, 1998

(30) Foreign Application Priority Data

Dec. 31, 1996 (GB) ..... 9627119

(51) Int. Cl.[7] ..... H01F 13/00

(52) U.S. Cl. ..... 361/143; 361/139; 361/156

(58) Field of Search ..... 361/143, 149–151, 361/267, 145, 156, 155; 335/284; 307/101; 29/607; 320/166

(56) References Cited

U.S. PATENT DOCUMENTS 3,143,689 * 8/1964 Hall .
4,153,858 * 5/1979 Schylander ..... 361/150
5,469,321 11/1995 Stupak, Jr. .

FOREIGN PATENT DOCUMENTS 2 069 259 8/1981 (GB) ..... H01F/13/00

* cited by examiner

*Primary Examiner*—Fritz Fleming
(74) *Attorney, Agent, or Firm*—Pollock, Vande Sande & Amernick, R.L.L.P.

(57) ABSTRACT

An apparatus (10) for altering the magnetic state of a permanent magnet comprises a coil inductor (26) for generating and applying an induced magnetic field to the permanent magnet. The coil inductor (26) is provided in circuit between two charge storage elements (20, 24). The apparatus also comprises a discharge control circuit (28) for transferring charge alternately in opposed directions between the storage elements (20, 24) though the coil inductor (26) to generate a series of alternating polarity magnetic field pulses (167, 191) of decreasing magnitude in the coil inductor (26) or to generate a single magnetic pulse of relatively high strength. The apparatus (10) can be operated as either a magnetising or demagnetising device and is capable of demagnetising a column of 200 or more magnets.

24 Claims, 8 Drawing Sheets

| | |
|---|---|
| FIG. 2A | FIG. 2B |
| FIG. 2C | FIG. 2D |

APPARATUS FOR ALTERING THE MAGNETIC STATE OF A PERMANENT MAGNET

BACKGROUND OF THE INVENTION

This invention relates to an apparatus for altering the magnetic state of a permanent magnet and particularly, though not exclusively, to a magnetiser or demagnetiser for use with highly permanently magnetic Rare-Earth Transition Metal magnets such as Nd—Fe—B or Sn—Co based magnets

FIELD OF THE INVENTION

Demagnetisation of ferromagnetic components is often necessary in industry to facilitate handling or coating of the components. In addition, demagnetisation also prevents unwanted pick up of magnetic debris.

One way of achieving demagnetisation is to heat the components to a temperature above their ferromagnetic Curie temperature; on cooling back down to below the Curie temperature, the permanent magnetism is lost. This is a costly, time-consuming process which is not suitable for many materials due to corrosion problems or for an assembly containing plastics material, for example.

Demagnetisation of a ferromagnetic component may also be achieved magnetically by applying successively smaller opposing magnetic fields to the magnetised component so as to drive the component around successively smaller magnetic hysteresis loops, until the component is demagnetised. For materials which are only slightly permanently magnetic, such as mild steel, the magnetic demagnetisation may readily be achieved by slowly withdrawing the component from the centre of a magnetic field generated by a mains driven A.C coil inductor.

For materials which are more permanently magnetic, such as harder steels, and ferrite and Alnico permanent magnets, a single shot "ringing" capacitor discharge demagnetiser is used. capacitor discharge magnetisers work by discharging a charged bank of capacitors through a coil inductor thereby producing a magnetic field which magnetises the component. Conventional capacitor discharge demagnetisers work on a similar principle, but the demagnetising circuit is designed such that on discharge, a decaying resonance or ringing occurs, with electromagnetic energy transferred successively between the coil inductor and the capacitor bank. This ringing phenomenon, combined with the natural loss of energy associated with coil inductors, ensures the generation of a reversing magnetic field of decaying amplitude which demagnetises the component.

There are many difficulties with magnetically demagnetising the most permanently magnetic materials such as Rare-Earth Transitional Metal magnets based on Nd—Fe—B or Sm—Co. Use of a single-shot ringing demagnetisation circuit is not possible for these magnetic materials because any such circuit would not ring with sufficient efficiency, that is with a high enough Q-factor, at the high power levels required for these materials. At present, the only way of magnetically demagnetising Rare-Earth Transition Metal permanent magnets is to apply about 20 or more magnetic pulses of reversing sign and decreasing amplitude with a conventional capacitor discharge demagnetiser. After the discharge of each pulse, the operator has to wait for the capacitors to recharge up to the new level and has to reverse the connections to the demagnetising coil. This is a very time-consuming procedure and is not practicable in an industrial environment.

SUMMARY OF THE INVENTION

It is desired to overcome the above-mentioned problems and to provide an apparatus which is capable of altering the magnetic state of a permanent magnet in an efficient, controllable and relatively quick manner.

According to one aspect of the present invention there is provided an apparatus for altering the magnetic state of a permanent magnet, said apparatus comprising: a magnetic field inducing device for generating and applying an induced magnetic field to said permanent magnet, said device being provided in circuit between two charge storage elements; and means for transferring charge alternately in opposed directions between said storage elements through said magnetic field inducing device to generate a series of alternating polarity magnetic field pulses of decreasing magnitude in said device.

Preferably the apparatus is arranged to demagnetise a column of Nd—Fe—B permanent magnets, for example 200 or more magnets, in a single operation. This can be achieved by the magnetic field inducing device being a coil inductor which is long enough to accommodate the column of magnets. The uniform demagnetisation or a column of permanent magnets is considerably more difficult than the demagnetisation of a single magnet. This difficulty is due in part to the differences of the degree of permeability at the ends of the column as compared with the middle of the column. However, the present invention advantageously overcomes these problems and permits the demagnetisation of relatively large numbers of permanent magnets in a single operation.

Preferably the transferring means is also arranged to discharge charge stored in the storage elements into the magnetic field inducing device to generate a single magnetic field pulse of sufficient amplitude to magnetise the magnet. The apparatus may also be arranged to connect together both of the storage elements to provide a single charge storage means which has a greater charge storage capacity than either of the individual charge storage elements. In this way, the apparatus can advantageously be arranged to carry out both magnetisation and demagnetisation in a fast and efficient manner.

Preferably, the apparatus further comprises adjusting means for comparing the amount of charge present in the storage elements with a predetermined set level and for adjusting the amount to be equivalent to the set level between each charge transfer. The provision of adjusting means advantageously allows the charge received by a storage means to be topped up to a predetermined set level before the next charge transfer. Accordingly, the size of the decreasing envelope of magnetic pulses can be accurately controlled and, in particular, the amplitude of step size between successive magnetic pulses can be set by the operator. The step size is important because if it is too large, the magnet, will be left with an undesirable residual magnetism after the demagnetisation procedure, and if the step size is too small, the demagnetisation procedure will take too long and not provide an industrially practical solution.

The apparatus may be arranged to commence each operation for altering the magnetic state of the magnet from a different storage element to that used in the previous operation. By alternating the starting storage element, the working life of the storage elements is advantageously maximised.

The magnetic field inducing device may comprise a plurality of individual magnetic field inducing devices, such as coil inductors, which are arranged to be selectively connected into circuit after each operation for altering the magnetic state of the magnet. The provision of several magnetic field inducing devices advantageously reduces the time period between successive demagnetisation or magnetisation operations which would otherwise be required for the magnetic field inducing device to cool down between operations.

According to another aspect of the present invention there is provided an apparatus for changing the magnetic state of a permanent magnet to a desired magnetic state, said apparatus comprising: means for charging a first charge storage element to a predetermined level; means for generating a magnetic field pulse by discharging said first storage element into a second storage element via a magnetic field inducing device; means for generating another magnetic field pulse of a different polarity and a different magnitude than that of said previous pulse by discharging said second storage element into said first storage element via said magnetic field inducing device; said generating means being arranged to be operated alternately to provide a series of alternating polarity magnetic field pulses of decreasing magnitude in said device.

According to another aspect of the present invention, there is provided an apparatus for demagnetizing a permanent magnet by spiralling it around its hysteresis loop, said apparatus comprising: means for generating an electromagnetic field; first and second charge storage means connected together and to said field generating means for transferring charge between each other via said field generating means; and control means for controlling the charging and discharging thereof so as, in use of the apparatus, to cause said field generating means to generate an alternating polarity reducing magnetic field.

According to another aspect of the present invention there is provided in or for an apparatus for altering the magnetic state of a permanent magnet by application thereto of a magnetic field of alternating polarity and decreasing strength, a control circuit for controlling the generation of said magnetic field by discharge of first and second charge storage means through a magnetic field generating means, said control circuit being adapted and arranged for transferring charge between said first and second charge storage means by way of said magnetic field generating means so as to subject a permanent magnet within the magnetic field of said magnetic field generating means to a sequence of alternating polarity magnetic impulses of progressively decreasing strength appropriate to the demagnetisation of the permanent magnet.

The present invention also extends to a method of altering the magnetic state of a permanent magnet, said method comprising: providing a magnetic field inducing device for generating and applying an induced magnetic field to said magnet said device being provided in circuit between two charge storage elements; transferring charge alternately in opposed directions between said storage elements through said device to generate a series of alternating polarity magnetic field pulses of decreasing magnitude in said device.

According to another aspect of the present invention there is provided a method of changing the magnetic state of a permanent magnet, said method comprising: charging a first charge storage element to a predetermined level; discharging said first storage element into a second charge storage element via a magnetic field inducing device to generate a magnetic field pulse; discharging said second storage element into said first storage element via said magnetic field inducing device to generate another magnetic field pulse of different magnitude and different polarity than that of said previous magnetic pulse; and repeating said discharging steps to generate a series of alternating polarity magnetic field pulses of decreasing magnitude in said device until said permanent magnet has reached a desired magnetic state.

The above and further features of the invention are set forth with particularity in the appended claims and together with the advantages thereof will become clearer from consideration of the following detailed description of an exemplary embodiment of the present invention.

DETAILED DESCRIPTION OF EXEMPLARY EMBODIMENTS

Figure 1:
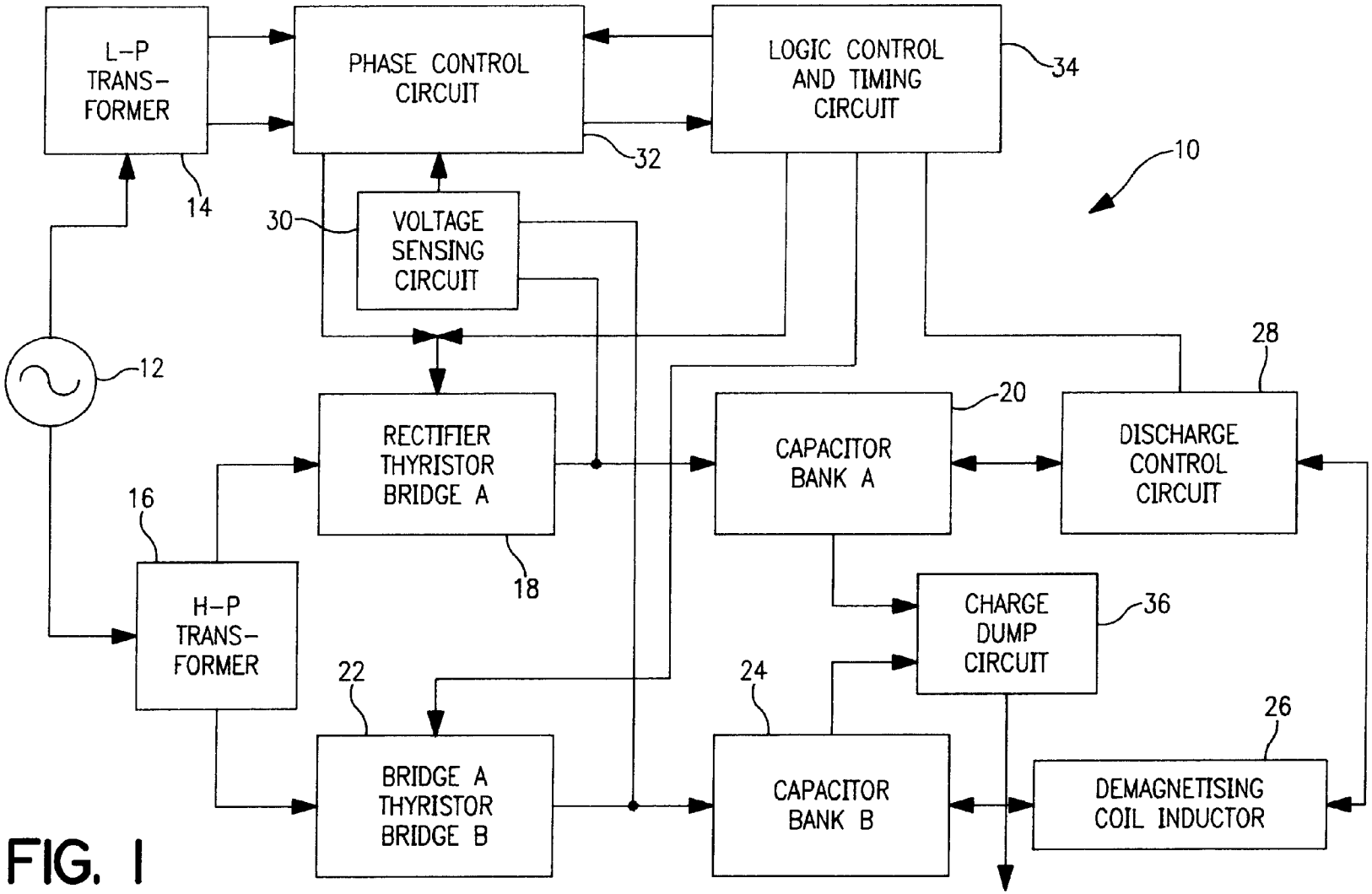
FIG. 1 is a schematic block diagram of a capacitor discharge demagnetiser embodying the present invention.

Referring to FIG. 1 there is shown a schematic block diagram of a capacitor discharge demagnetiser 10 embodying the present invention which can demagnetise a plurality of Rare-Earth Transition Metal permanent magnets in a single operation. The demagnetiser 10 is powered from a 240 Volt AC mains supply 12 which feeds a low-power transformer 14 and a high-power transformer 16. The high-power transformer steps up the mains supply voltage from 240 Volts to 550 Volts, namely a voltage which is large enough to carry out the demagnetisation procedure. The low-power transformer 14 is used for generating a D.C. power supply and a circuit timing signal which is discussed in detail elsewhere.

Rectifier thyristor bridge A 18 rectifies the stepped up voltage from the high-power transformer 16 and supplies current to capacitor bank A 20. The use of thyristors instead of diodes enables the charging of capacitor bank A 20 to be controlled by selective firing of the thyristors. Similarly, rectifier thyristor bridge B 22 is also powered by the high-power transformer 16 and selectively supplies charge to capacitor bank B 24.

Figure 2A:
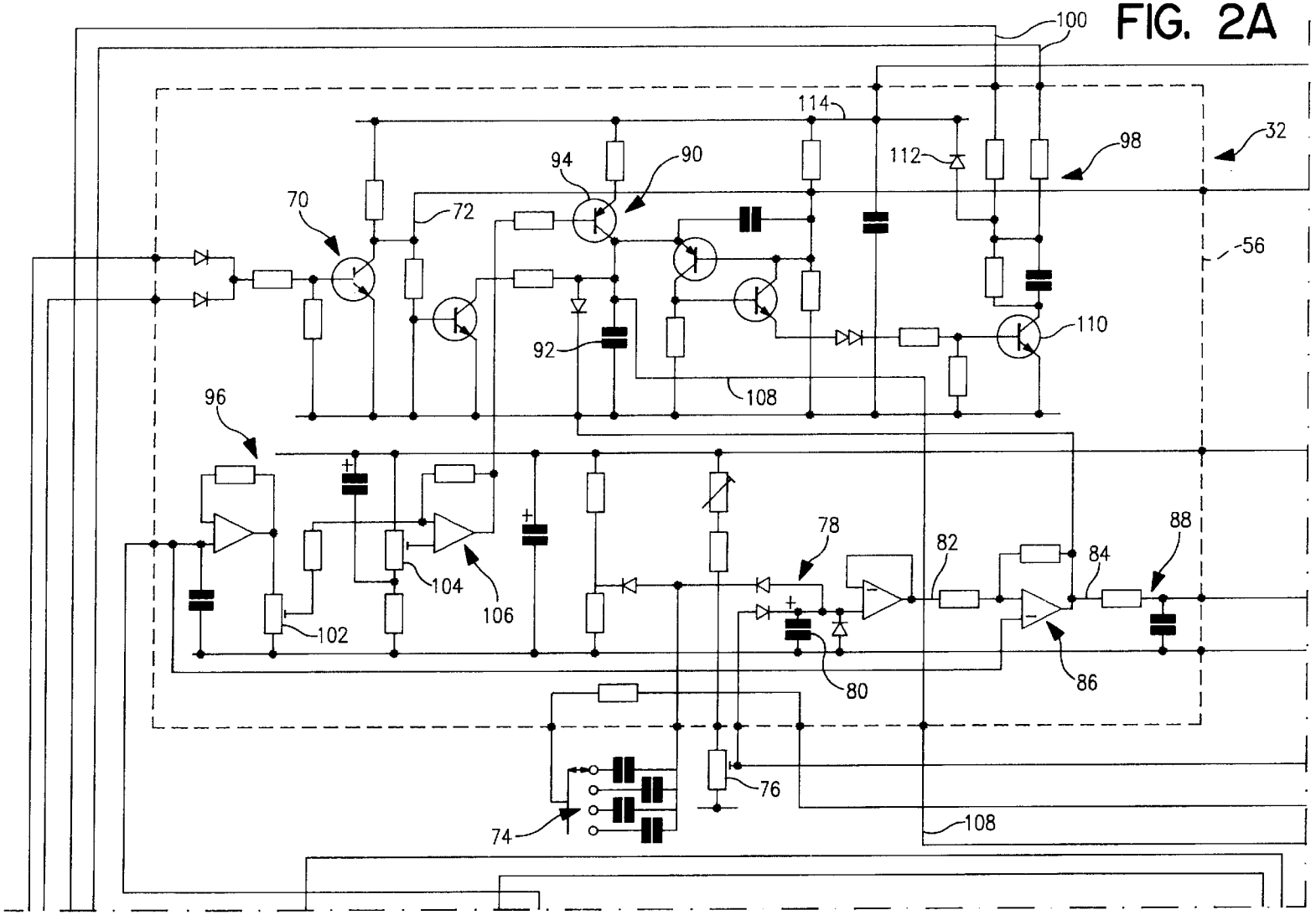
FIGS. 2A, 2B, 2C and 2D are detailed circuit diagrams of the capacitor discharge demagnetiser of FIG. 1, and fit together as shown schematically in FIG. 2.
Figure 2B:
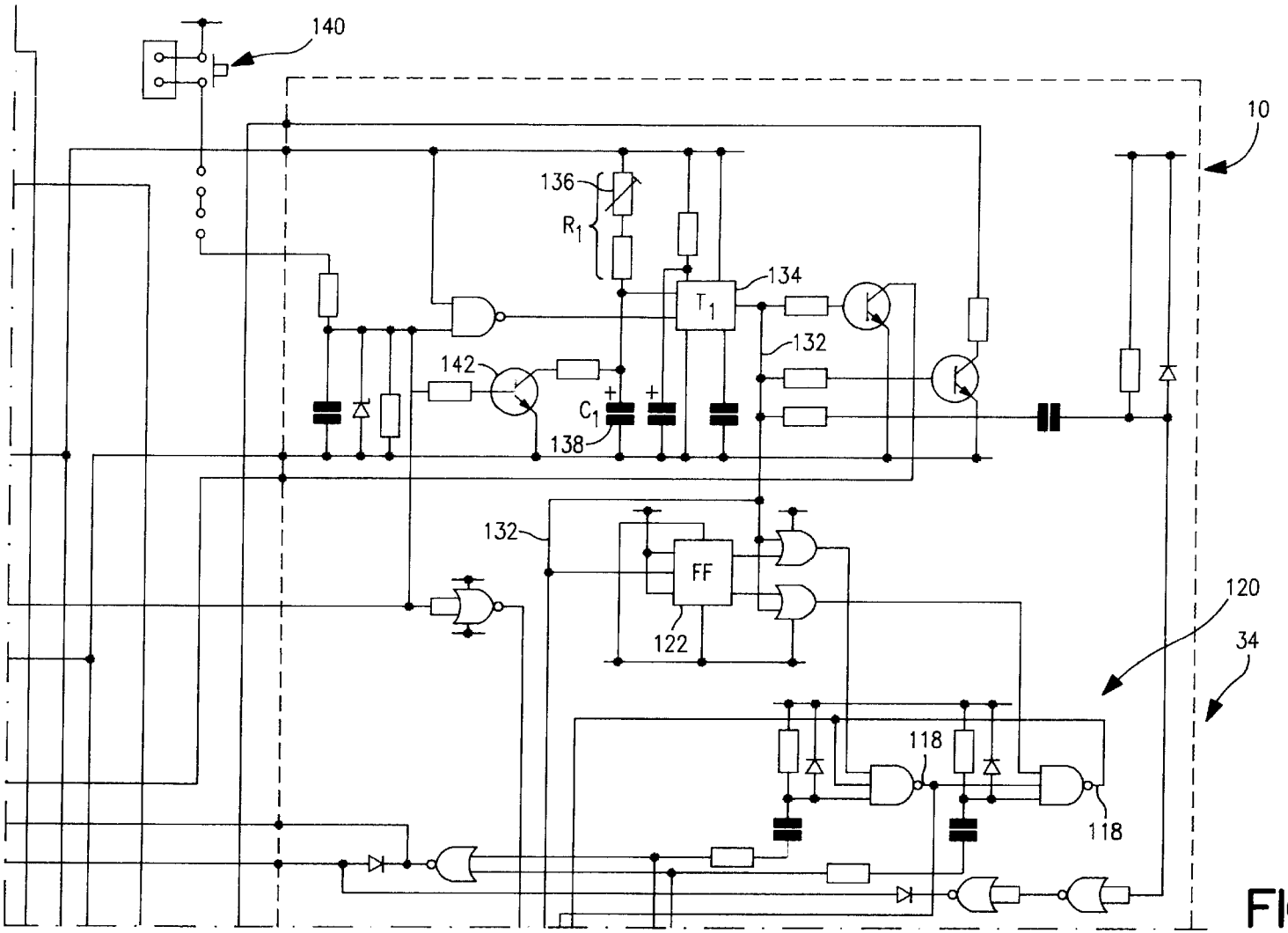
Figure 2C:
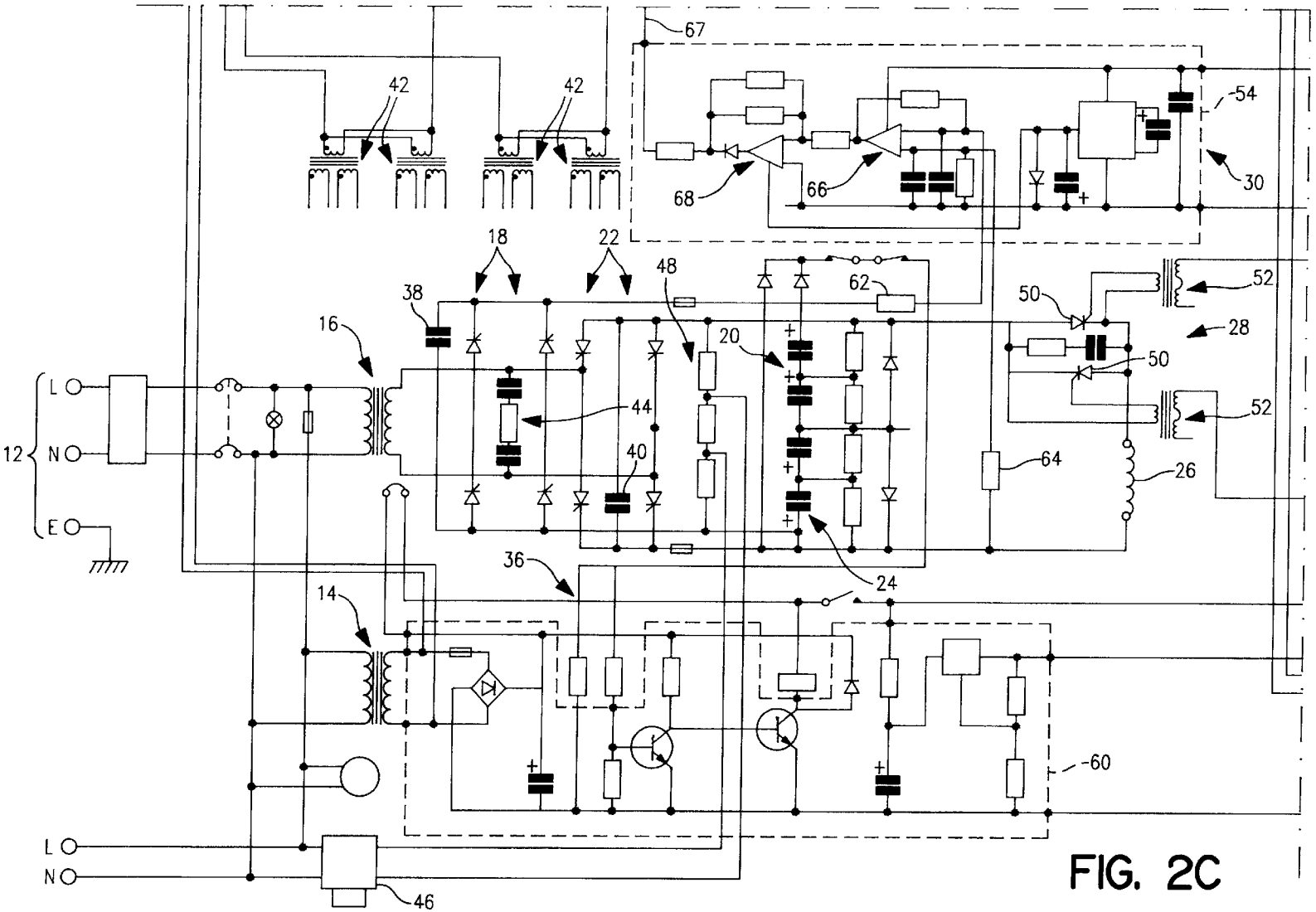
Figures 2, 2D:
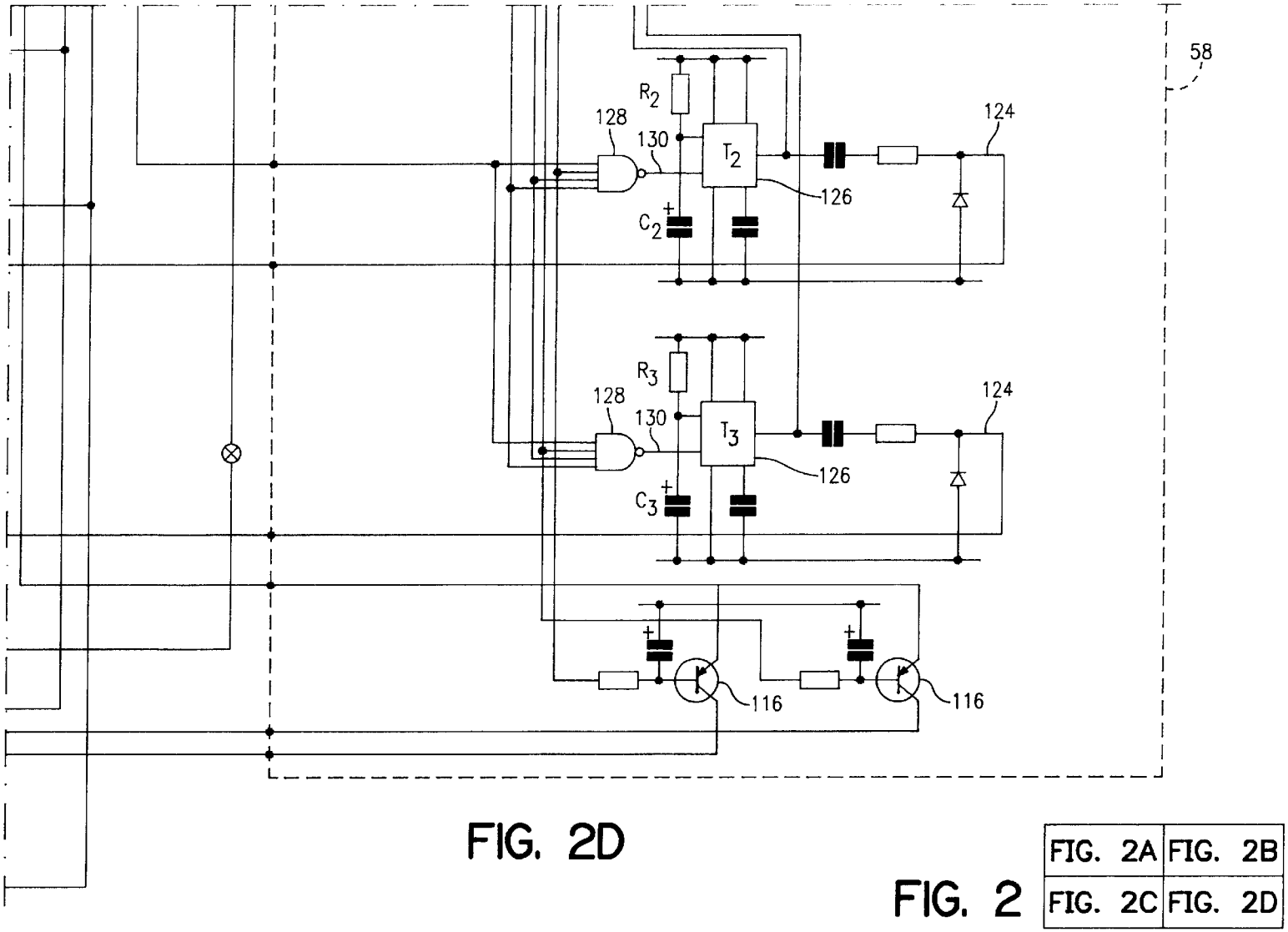

It should be noted that in the present embodiment each capacitor bank 20, 24 as shown in FIG. 1 actually comprises two smaller capacitor banks connected together in series as shown in FIG. 2. For the sake of convenience, references made herein to either capacitor bank 20, 24 should be taken to be to the appropriate two smaller capacitor banks connected in series.

The capacitor banks 20, 24 are connected together via a demagnetising coil inductor 26 and a discharge control circuit 28. The demagnetising coil inductor 26 applies an induced magnetic field to the permanent magnets (not shown) which are to be demagnetised, in dependence upon the size and polarity of the current flowing through the coil inductor 26. The discharge control circuit 28 can be triggered to allow charge flow to flow from either one capacitor bank 20,24 to the other capacitor bank 20, 24 through the coil inductor 26.

The charging voltages of each capacitor bank 20, 24 is continually sensed by a voltage sensing circuit 30 and a voltage difference signal is sent to a phase control circuit 32. The phase control circuit 32 determines the correct voltage level that each capacitor bank 20, 24 should be at and sends this information to a logic control and timing circuit 34. The phase control circuit 32 is also coupled to the low-power transformer 14 and generates a full-wave rectified signal which is used as a phase clock signal, described in detail hereinafter.

The logic control and timing circuit 34, is coupled to and controls the operation of each thyristor bridge 18, 22. In this way, the logic control and timing circuit 34 can increase the amount of actual charge stored in the capacitor banks 20, 24 to a correct level. In addition, the logic control and timing circuit 34 triggers the discharge control circuit 28 at the appropriate time to transfer charge stored in one capacitor bank 20, 24 to the coil inductor 26. The direction of charge flow between the capacitor banks 20, 24 is also controlled by the logic control and timing circuit 34.

A charge dump circuit 36 is also provided and is coupled to each of the capacitor banks 20, 24. The charge dump circuit 36 acts as a safety device to dump charge from the capacitor banks 20, 24 in the event of an interruption in the discharging cycle. In addition, as the demagnetiser 10 is kept in a charged up state between demagnetisation operations, the dump circuit 36 also allows the capacitor banks 20, 24 to be safely discharged when the demagnetiser 10 is to be turned off.

The above described circuit is arranged to demagnetise a column of fully or partially magnetised Rare-Earth Transition Metal permanent magnets such as Nd—Fe—B or Sm—Co based magnets. The principle of demagnetisation is based upon applying a reversing magnetic field of decaying amplitude to the magnets which forces the magnetic material around its hysteresis loop in successively decreasing magnetic cycles, i.e. in a spiral. The way in which the demagnetiser 10 achieves this is described below.

When the demagnetiser 10 is switched on, capacitor bank A 20 is charged up to a predetermined level via the thyristor bridge A 18. The above-mentioned column of magnets is then placed within the coil inductor 26. The charge control circuit 28 is fired and the charge in the capacitor bank A 20 is discharged into the coil inductor 26 thereby inducing a magnetic field pulse of given size and direction. The demagnetiser 10 is designed so that it rings once into and partially charges capacitor bank B 24. The capacitor bank B 24 is then similarly discharged producing a magnetic field pulse in the opposite direction in the coil inductor 26, and partially charges up capacitor bank A 20 again. Each discharge of a capacitor bank 20, 24 into the coil inductor 26 decreases the amount of charge being passed between the capacitor banks 20, 24 and also reduces the resultant magnetic field pulse being applied to the column of magnets. The successive discharging is repeated to generate a series of alternating polarity magnetic field pulses of decaying magnitude, until the capacitor banks 20, 24 are completely discharged. At this point the column of magnets will be demagnetised.

At each state of the above process, the capacitor bank 20, 24 having been partially charged by the discharge of the other capacitor bank 20, 24, may be charged up to a predetermined level. This is done by first measuring the difference in voltages across the capacitor banks 20, 24 using the voltage sensing circuit 30. The measured voltage is proportional to the amount of charge present in a given capacitor bank 20, 24. The measured voltage difference is compared with the predetermined voltage level by the phase control circuit 32 and if the voltage across the charged capacitor bank 20, 24 needs to be increased, a control signal is sent to fire the appropriate thyristor bridge 18, 22 to increase the charge stored in the corresponding capacitor bank 20, 24. Once the measured voltage difference accords with the predetermined voltage level, the charged capacitor bank 20, 24 is ready for discharging. By reducing the predetermined voltage stored in the phase control circuit 32 by a given amount (step) at each discharge stage, the precise decaying amplitude of the reversing magnetic field being applied to the column of magnets can be controlled.

FIGS. 2A, 2B, 2C and 2D show in detail the electronic circuit configuration of the capacitor discharge demagnetiser 10. The main part of the circuit comprises the thyristor bridges 18, 22, the capacitor banks 20, 24, the discharge control circuit 28 and the demagnetising coil inductor 26. Rectifier thyristor bridge A 18, includes four thyristors 1A, 2A, 3A, 4A arranged in a standard rectifying bridge configuration with a capacitor 38 provided across the bridge. Rectifier thyristor bridge B 22 also comprises four thyristors 5B, 6B, 7B, 8B in the same configuration and has a capacitor 40 positioned across the bridge. Each of the thyristors 1A, 2A, 3A, 4A, SB, 6B, 7B, 8B is connected to an associated low-power charging transformer 42 which, when activated, generates a trigger pulse for firing each thyristor 1A, 2A, 3A, 4A, SB, 6B, 7B, 83. A snubber network 44 is provided between the thyristor bridges 18, 22 to suppress any high-frequency signals which might cause misfiring of the thyristors.

The thyristor bridges 18, 22 convert the A.C. mains power supply 12 output from the transformer 16 into a constant charging current for the capacitor banks 20, 24. Each capacitor bank 20, 24 comprises two sets in series of 24 high-voltage electrolytic capacitors connected in parallel to provide a total of 80,000 $\mu$F of capacitance per bank. These capacitors are selected to each to operate at 325 Volts and each has a voltage rating well in excess of this voltage value. The instantaneous voltage across each capacitor bank 20, 24 is measured and the difference therebetween is displayed by a digital voltmeter 46 which is connected to a resistor network 48 across the capacitor banks 20, 24. The display of the voltage difference provides an indication of how the process is progressing and also indicates when the process has been completed.

The discharge control circuit 28 comprises a pair of thyristors 50 arranged to allow charge to flow in opposite directions. However, at any one time only one thyristor is operational and so, current is only allowed to pass between the capacitor banks 20, 24, in one selected direction for each charge transfer. Each thyristor 46 is coupled to a low-voltage discharge transistor 52 which when activated generates an appropriately sized and shaped trigger pulse to fire the thyristor 50.

The rest of the capacitor discharge demagnetiser 10 is essentially divided between four circuit boards namely, the voltage sensing board 54, the phase control circuit board 56, the logic circuit board 58 and the power supply board 60.

The voltage sensing board 54 provides the voltage sensing circuit 30. Voltages present across each capacitor bank 20, 24 are input via resistors 62, 64 to a differential amplifier 66. The output signal of the differential amplifier 66 represents the voltage difference between the capacitor banks 20, 24 and serves to indicate how much charge is present in each capacitor bank 20, 24. The output of the differential amplifier 66 is converted into an absolute voltage value signal at 67 by rectifier amplifier 68. This voltage value signal is then passed to the phase control circuit 32 on the phase control circuit board 56.

The phase control circuit board 56 includes a zero-crossing point circuit 70 which monitors the output of the low-voltage transformer 14 and generates a phase clock signal at 72 for synchronising all of the events that occur in the operation of the demagnetiser 10. In particular, the phase clock signal is supplied to the logic circuit board 58 for synchronising the discharge of the capacitor banks 20, 24.

The phase control circuit 32 determines the set level to which each capacitor bank 20, 24 is charged during the demagnetisation operation and how that level decreases with each capacitor discharge event. operator selection of the appropriate step size capacitor 74 determines the step size by which the set level is to be decreased during the demagnetisation procedure. The set level is determined by potentiometer 76 which is also under operator control. The step size capacitors 74 and the set level potentiometer 76 are both connected to a diode pump circuit 78. The diode pump circuit 78 is arranged to extract a small amount of charge from a main capacitor 80 and transfer the charge to the selected step size capacitor 74 each time the pump circuit 78 is fired. This has the effect of reducing the initial set level voltage at 82 output from the diode pump circuit 78 in a series of constant voltage steps until the output set level voltage at 82 is zero.

A ready signal at 84 for initiating the discharge of the charged capacitor bank 20, 24 is produced from the output of a comparator 86 which compares the present absolute voltage value signal at 67 from the voltage sensing board 54 with the output voltage at 82 of the diode pump circuit 78. When the absolute voltage signal at 67 reaches the predetermined set level voltage at 82 the comparator 86 drives the ready signal at 84 into an active condition. The resistor/capacitor circuit 88 provides a 1 mS delay in the activation of the ready signal at 84. The output of the comparator 86 is also passed to a charge timing circuit 90 which comprises a phase control capacitor 92, a constant current charging transistor 94, a control circuit 96 for the charging transistor 94 and an output circuit 98 coupled to the charging transformers 42.

The charge timing circuit 90 is input with the phase clock signal at 72 and outputs a pulsed control signal at 100 for repetitively firing the charging transformers 42. The phase angle of the control signal at 100 is varied in dependence upon charge stored in the phase control capacitor 92. The phase control capacitor 92 is charged from the charging transistor 94, the base of which is in turn controlled by the control circuit 96. The control circuit 96 includes potentiometer 102 for setting the rate of rise of the capacitor bank charging, potentiometer 104 for setting the starting point of the capacitor bank charging and a comparator 106 for comparing the voltages generated from each potentiometer 102, 104. The absolute voltage value signal at 67 is input into the control circuit 96 to generate a voltage across potentiometer 102.

The output of comparator 86 is an active low signal which acts to discharge the phase control capacitor 92 of the charge timing circuit. 90. In addition, the phase control capacitor 92 is connected to the logic control board 53 via an override control line 108 which acts to disable the charge timing circuit 90 when required. When the override control line 108 is activated, transistor 110 is turned off and the output at 100 floats high. This causes the charging transistor 42 to also be disabled so they cannot be fired.

The logic control and timing circuit 34 on the logic control board 58 generates timing signals for enabling the operation of the charging transformers 42 and for controlling the discharging transformers 52. Each of the charging transformers 42 is coupled to a respective driver transistor 116 which can selectively enable operation of the charging transformers 42. Each driver transistor 116 is operated in opposition, namely when one is switched on, the other is switched off. The bases of the driver transistors 116 are coupled to respective outputs 118 of a bistable circuit 120 which determines which thyristor bridge la, 22 is to be operational, i.e. which capacitor bank 20, 24 is to be charged up. The start up configuration of the bistable circuit 120 is determined by flip-flop 122 which is provided to alternate the capacitor bank 20, 24 which is first to be discharged in a demagnetisation operation. Alternating the start up capacitor banks 20, 24 for each demagnetisation operation advantageously extends the operational life of the capacitor banks 20, 24.

Each of the discharging transformers 52 is controlled by the output 124 of a respective timer 126. The timers 126 are each configured to generate a timing pulse of 100 ms duration when appropriately triggered. A four input Nand gate 128 is provided on the trigger input 130 of each timer 126 such that four input signals must be at a high logic level to trigger one of the timers. The outputs 118 of the bistable circuit provide one input signal for each timer 126. These inputs are provided to permit operation of one timer 126 at one moment in time and simultaneously to prevent operation of the other timer 126. This selection ensures that discharging of the capacitor banks 20, 24 only occurs in one direction at a time.

Another input to the Nand gates 128 is provided by the ready signal at 84 which indicates when the voltage level on the capacitor banks 20, 24 is at the predetermined set level for the next discharge. The phase clock signal at 72 is also input to the Nand gates 130 to ensure that the discharge triggering is synchronised with the phase of the power supply 12.

The last input to the Nand gates 128 is a demagnetisation operation enable signal 132 which is output from a timer 134. This signal 132 is provided for turning off the discharge timers 126 at the end of a demagnetisation operation. The timer 134 is configured to have a user selectable time delay, typically of the order of 5 seconds, which is set by potentiometer 136 in combination with a timing capacitor 138.

The timer 134 is triggered by the depression of a push button 140 which is provided for the user to press when a demagnetisation operation is to be commenced. In use, once the timer 134 has been triggered, it is prevented from reaching the end of its timing period by the continual discharging of the timing capacitor 138 by transistor 142. However, once the end of a demagnetisation operation has been reached, as signified by the continuous presence of an active ready signal at 84, the transistor 142 is turned off for long enough to allow the timing capacitor 138 to charge up and allow the timer 134 to reach the end of its timing period. The disenabling of the demagnetisation operation enable signal 132 also resets the phase control circuit 32 ready for the next demagnetisation operation.

Figure 3A:
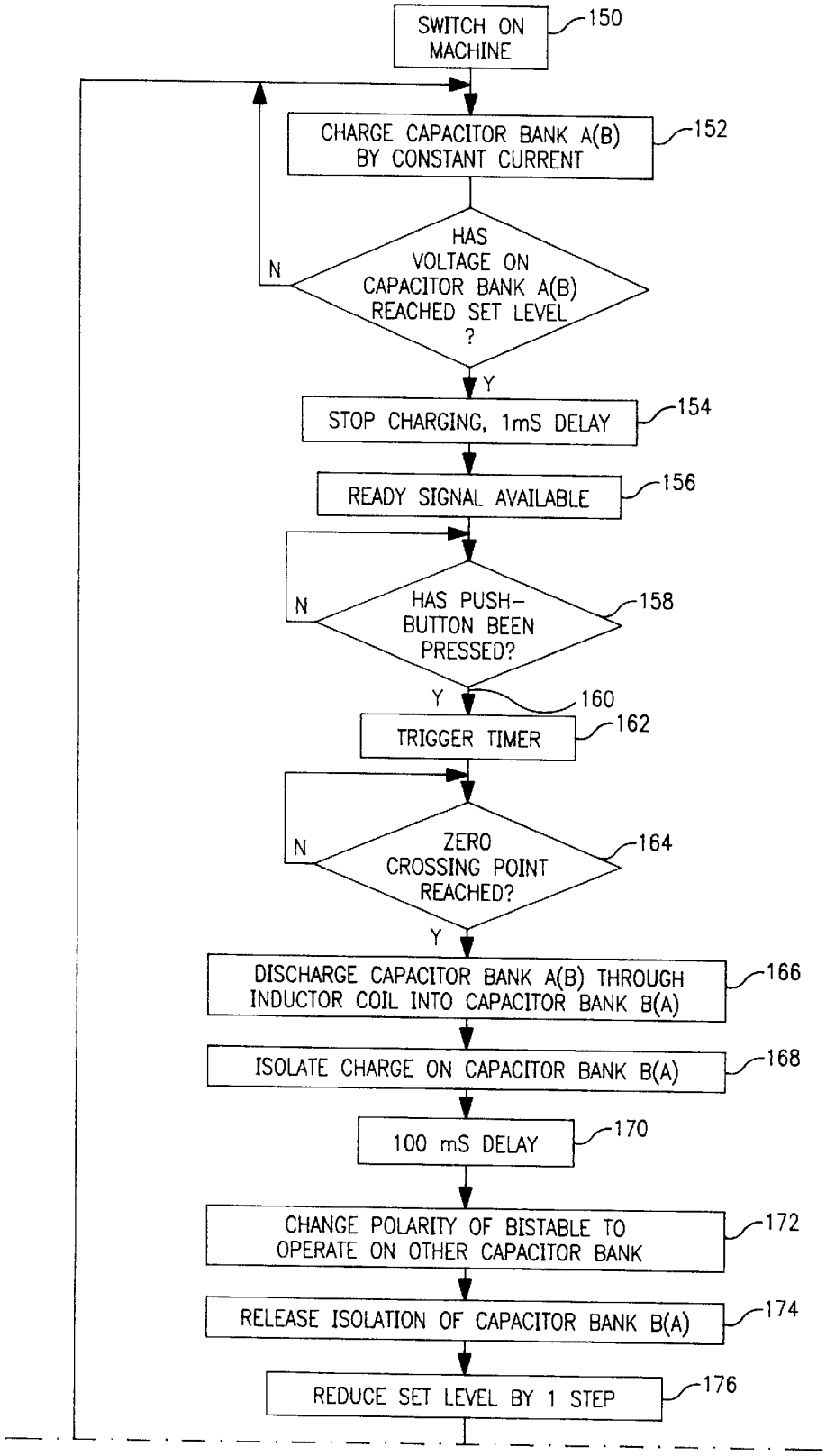
FIG. 3 is a flow diagram showing how the capacitor discharge demagnetiser operates.
Figure 3B:
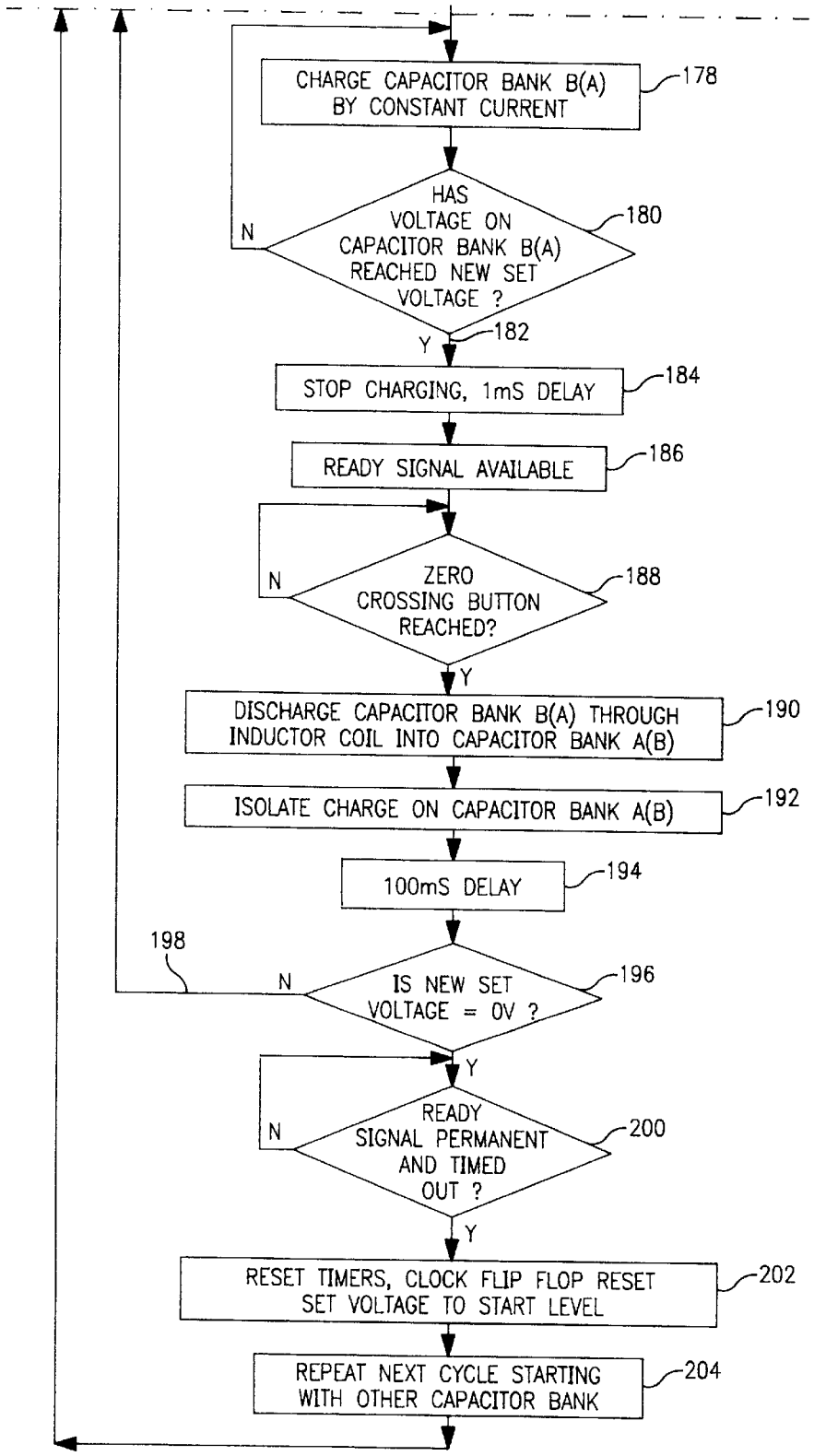
Figure 4:
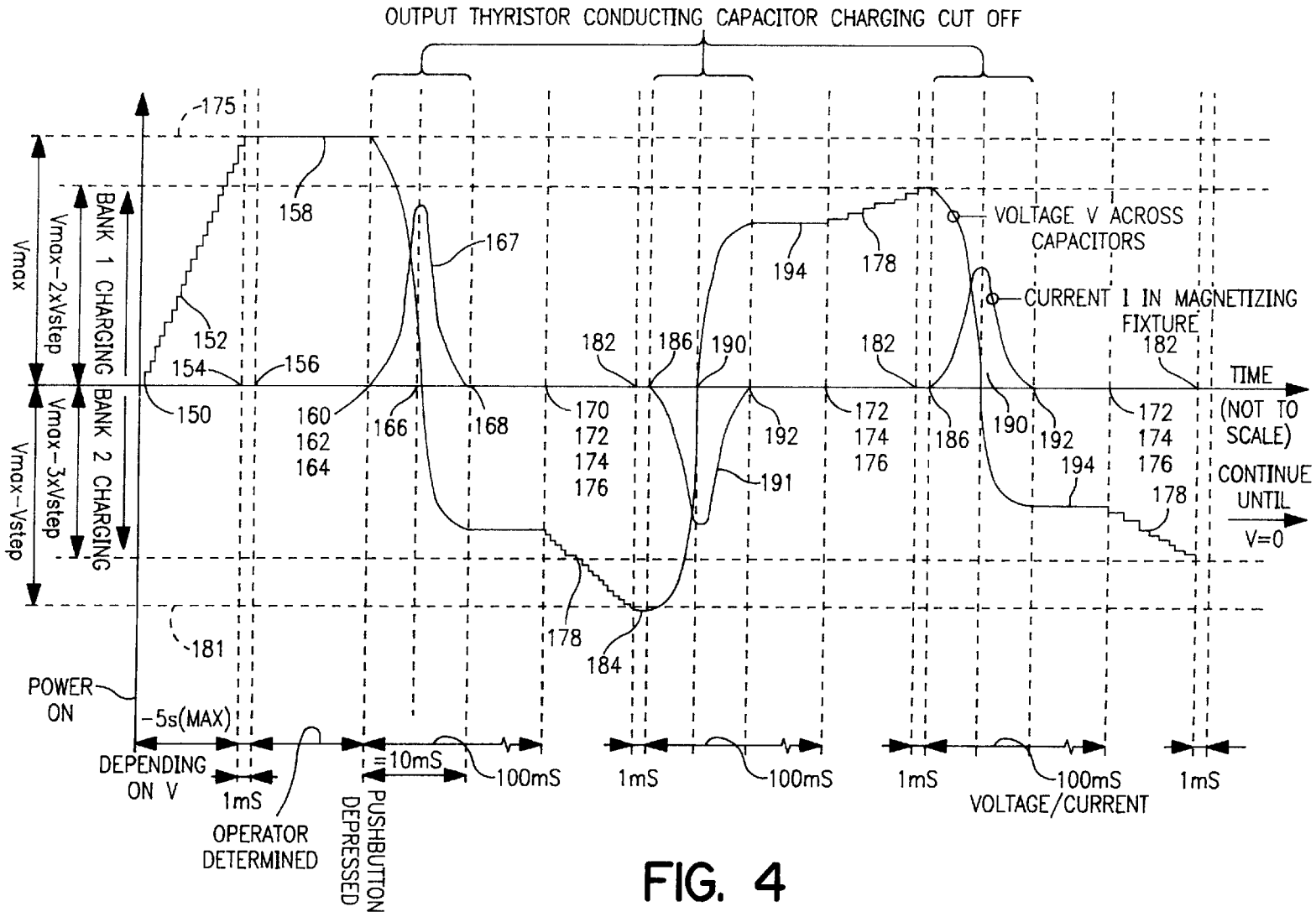
FIG. 4 is a timing diagram showing how demagnetiser of FIG. 1 produces a series of alternating polarity magnetic field pulses of decreasing amplitude from each capacitor discharge.

Referring now to FIGS. 3 and 4, the steps involved in operating the abovedescribed demagnetiser will now be described. The demagnetisation operation commences with the turning on of the demagnetiser 10 at 150. At this time, one of the capacitor banks 20, 24 is selected and is charged by a constant current at 152 because voltage across the capacitor banks 20, 24 has not reached the predetermined set level. Once, the predetermined set level has been reached at 154, the charging is disabled and the delay of 1 mS is generated. At the end of the delay, the ready to discharge signal is activated at 156.

The demagnetiser 10 is now ready to commence a demagnetisation operation and the operator can place one or more permanent magnets to be demagnetised into the coil inductor 26. The demagnetiser 10 remains in charged state at 158 until the pushbutton 140 is depressed by the operator at 160. The demagnetisation operation commences by the triggering of the timer 134 at 162 and waiting at 164 until the zero-crossing point is reached (determined by phase clock signal). Then charged capacitor bank A 20 is discharged through the inductance coil 26 into the capacitor bank B 24 at 166. The discharge at 166 has the effect of generating a magnetic pulse 167, the size of which is determined by the amount of charge that is discharged into the coil inductor 26.

Once the capacitor bank A 20 has discharged most of its charge and the capacitor bank B 24 has received all of the charge not used by the coil inductor 26, the charge on the capacitor bank B 24 is isolated at 168. The isolation prevents any leakage of the transferred charge back into the coil inductor 26. Once a 100 mS delay has been completed at 170, the polarity of the bistable circuit 120 is changed at 172, the isolation of the capacitor bank B 24 is released at 174 and the set level voltage 175 is reduced by 1 step at 176.

The capacitor bank B 24 is charged by a constant current at 178 and checks are made at 180 to establish whether the measured voltage across the capacitor bank B 24 is equivalent to the new set level voltage 181. When the new set level voltage 181 is reached at 182, the charging of the capacitor bank B 24 is stopped and a 1 ms delay is generated at 184. A ready to discharge signal becomes available at 186. Discharging of the capacitor bank B 24 at 190 does not occur until the zero-crossing point has been reached at 188.

Discharge of the capacitor bank B 24 is from a lower set level voltage 181 than the original set level voltage 175 and accordingly, a magnetic pulse 191 is generated which is of a smaller magnitude than the previous pulse 167. The charge received by the capacitor bank A 20 is isolated at 192 and the voltage level across the capacitor bank A 20 is maintained until the end of a 100 mS delay at 194. Then the set level voltage is checked at 196 to determine whether it is set at zero volts. If the set level voltage has not yet reached zero volts at 198., steps 172 to 194 are repeated namely, the charging up of the capacitor bank A 20 to a new predetermined set level and the discharging of the charged capacitor bank A 20 into the other capacitor bank B 24. However, if the new set voltage is equivalent to zero volts, then the ready to discharge signal will be permanently active which signifies the end of the demagnetisation operation. The operation waits at 200 until the timer 134 has timed out and then continues at 202 with resetting the timer 126, 134, clocking the flip-flop 122 and resetting the set level voltage at 82 to a start level. The demagnetiser 10 is then ready at 204 to carry out another demagnetising operation on a new set of permanent magnets and as mentioned previously, this next operation is to be commenced from the other capacitor bank, in this case capacitor bank B 24. Accordingly steps 152 to 204 are repeated.

Each demagnetisation operation generates heat in the coil inductor 26 and the coil inductor 26 has to be cooled to a predetermined temperature between successive operations. A fan (not shown) is provided in the demagnetiser 10 for air cooling the coil inductor 26. However, it can take several minutes after the end of one operation before the coil has cooled sufficiently for the next operation. In another embodiment of the present invention, the single coil inductor can be replaced by a plurality, for example 5, coil inductors in parallel which can selectively be switched into circuit between the capacitor banks 20, 24. By switching in a different coil inductor 26 after each operation it is not necessary to wait for the coil inductor 26 to cool and the time taken for carrying out a series of demagnetisation operations is significantly reduced. The switching between different coil inductors can be effected either manually or automatically using relays.

It is also possible to replace the two capacitor banks 20, 24 of the described embodiment with a single capacitor, each plate of the capacitor being used as a charge storage means. The important requirements for the charge storage means are that they can withstand the high voltages to which they are subjected and that they can store sufficient charge for carrying out the demagnetisation operation.

The above described embodiments are designed to carry out demagnetisation. However, it is to be well understood that the invention is not limited to demagnetisation and can readily be used to magnetise a permanent magnet. A magnetiser embodying the present invention would be very similar to the previously described demagnetiser 10. However, rather than reducing the set level voltage by the step size between each capacitor bank discharge, the capacitor banks would be connected together in parallel and both charged up to their maximum level. Then both capacitor banks 20, 24 would be discharged in the same direction through the coil inductor 26 in a single non-ringing shot. The resultant magnetic field pulse would be of a sufficient strength to magnetise the magnet or column of magnets placed in the coil inductor 26. It can be seen that the demagnetiser 10 can readily be modified to provide both magnetisation and demagnetisation operations; the required operation being selected by the use of a simple switch.

As the predetermined maximum charge level is set by the operator, the permanent magnet can be magnetised to any level along its hysteresis loop, namely partial nagnetisation of the permanent magnet can be carried out. Similarly, in the demagnetiser 10, by setting the correct end voltage of the operation, partial demagnetisation can also be carried out. In this regard the use of the words "magnetise" or "demagnetise" in the claims should be understood to mean a respective increase or decrease in the permanent magnetism of the magnetic material and not be limited to a totally magnetised or totally demagnetised state.

Having described the present invention with reference to exemplary embodiments thereof, it is to be clearly understood that this is by way of illustration and example only and is not to be considered by way of limitation, the scope of the present invention being determined by the appended claims. For example, the main output thyristors 18 and 22 can advantageously be arranged to be triggered by lesser rated thyristors to obviate any risk of premature firing of the main thyristors and enable the capacitor banks 20 and 24 to be more completely discharged, the cathode of each lesser rated thyristor being connected to the gate of the respective main output thyristor. Furthermore, in order to render the described embodiment insensitive to differences in the power supply frequency in different countries so that one and the same apparatus can be used without need for modification in, say, 50 Hz countries such as the United Kingdom (GB) and in 60 Hz countries such as the United States of America (US), the capacitor charging circuits can be made time and voltage dependent rather than simply being voltage dependent as in the described embodiment. This can be achieved by inclusion of an additional IC in the circuit to make the phase control both time and voltage related, rather than just voltage related, the additional IC ensuring that the phase angle, which is time dependent, is set correctly so that the voltage-related part can operate correctly. Additionally, a further front panel button or switch may be provided, together with simple control circuitry, to allow single-discharge magnetizing operation of the described embodiment if required.

What is claimed is:

1. An apparatus for altering the magnetic state of a permanent magnet, said apparatus comprising:

a magnetic field inducing device for generating and applying an induced magnetic field to said permanent magnet, said device being provided in circuit between two charge storage elements; and means for transferring charge alternately in opposed directions between said storage elements through said magnetic field inducing device to generate a series of alternating polarity magnetic field pulses of decreasing magnitude in said device.

2. An apparatus according to claim 1, further comprising charging means for charging any of said charge storage elements to a predetermined set level.

3. An apparatus according to claim 2, further comprising disabling means for disabling the operation of said charging means during said charge transfer.

4. An apparatus according to claim 1, further comprising adjusting means for comparing the amount of charge present in said storage elements with a predetermined set level and for adjusting the amount to be equivalent to said set level between each charge transfer.

5. An apparatus according to claim 4, wherein said adjustment means comprises means for measuring the amount of charge stored in each of the storage elements between each charge transfer.

6. An apparatus according to claim 4, wherein said adjusting means comprises means for supplying charge to each of said storage elements before each charge transfer between said storage elements.

7. An apparatus according to claim 6, wherein the adjusting means further comprises means for controlling the supplying means to increase the amount of charge stored in any one of the storage elements to said predetermined set level.

8. An apparatus according to claim 4, wherein said adjusting means is arranged to decrease said predetermined set level by a selected step size between each charge transfer.

9. An apparatus as claimed in claim 1 wherein said apparatus is arranged to commence each operation for altering the magnetic state of said magnet from a different storage element to that used in the previous operation.

10. An apparatus according to claim 1, wherein the apparatus operates from an AC mains power supply and further comprises means for detecting the phase of the AC mains power supply, said phase detection means being arranged to supply a phase synchronised timing signal to said charge transferring means for phase synchronising said charge transfers.

11. An apparatus according to claim 1, wherein said magnetic field inducing device comprises a coil inductor within which can be placed one or more permanent magnets whose magnetic state is to be altered.

12. An apparatus according to claim 1, wherein said charge storage elements each comprise a plurality of high-voltage electrolytic capacitors.

13. An apparatus according to claim 1, wherein said charge transferring means is arranged to discharge most of the charge held in one of said storage elements and to transfer a significant amount of said charge into the other of said storage elements during each charge transfer.

14. An apparatus according to claim 1, wherein said charge transferring means comprises a thyristor circuit arranged to selectively control the direction and timing of charge flow between said storage elements.

15. An apparatus according to claim 6, wherein said charge supplying means comprises a pair of current rectifying thyristor bridges, each thyristor bridge being associated with one of said storage elements and being coupled to an AC mains power supply for rectifying the current supplied from said power supply.

16. An apparatus according to claim 1, further comprising means for dumping charge from said storage elements, said storage dump means being coupled to each of said storage elements and being arranged to effect a complete discharge of both of said storage elements.

17. An apparatus according to claim 1 wherein said magnetic field inducing device comprises a plurality of separate field inducing devices which are arranged to be selectively coupled into circuit after each operation for altering the magnetic state of said magnet.

18. An apparatus according to claim 1, wherein selectively operable means are further provided for enabling the discharge of charge stored in said storage elements into said magnetic field inducing device to generate a single magnetic field pulse of sufficient amplitude to magnetise a magnet subject thereto.

19. An apparatus according to claim 18, wherein, for magnetising a magnet, said apparatus is arranged to connect together both of said storage elements to provide a single charge storage means which has a greater charge storage capacity than either of said individual charge storage elements.

20. A method of altering the magnetic state of a permanent magnet, said method comprising:

providing a magnetic field inducing device for generating and applying an induced magnetic field to said magnet said device being provided in circuit between two charge storage elements;

transferring charge alternately in opposed directions between said storage elements through said device to generate a series of alternating polarity magnetic field pulses of decreasing magnitude in said device.

21. A method of changing the magnetic state of a permanent magnet, said method comprising:

charging a first charge storage element to a predetermined level;

discharging said first storage element into a second charge storage element via a magnetic field inducing device to generate a magnetic field pulse;

discharging said second storage element into said first storage element via said magnetic field inducing device to generate another magnetic field pulse of different magnitude and different polarity than that of said previous magnetic pulse; and repeating said discharging steps to generate a series ot alternating polarity magnetic field pulses of decreasing magnitude in said device until said permanent magnet has reached a desired magnetic state.

22. An apparatus for changing the magnetic state of a permanent magnet to a desired magnetic state, said apparatus comprising:

means for charging a first charge storage element to a predetermined level;

means for generating a magnetic field pulse by discharging said first storage element into a second storage element via a magnetic field inducing device;

means for generating another magnetic field pulse of a different polarity and a different magnitude than that of said previous pulse by discharging said second storage element into said first storage element via said magnetic field inducing device;

said generating means being arranged to be operated alternately to provide a series of alternating polarity magnetic field pulses of decreasing magnitude in said device.

23. An apparatus for demagnetising a permanent magnet by spiralling it around its hysteresis loop, said apparatus comprising:

means for generating an electromagnetic field;

first and second charge storage means connected together and to said field generating means for transferring charge between each other via said field generating means; and control means for controlling the charging and discharging thereof so as, in use of the apparatus, to cause said field generating means to generate an alternating polarity reducing magnetic field.

24. In or for an apparatus for altering the magnetic state of a permanent magnet by application thereto of a magnetic field of alternating polarity and decreasing strength, a control circuit for controlling the generation of said magnetic field by discharge of first and second charge storage means through a magnetic field generating means, said control circuit being adapted and arranged for transferring charge between said first and second charge storage means by way of said magnetic field generating means so as to subject a permanent magnet within the magnetic field of said magnetic field generating means to a sequence of alternating polarity magnetic impulses of progressively decreasing strength appropriate to the demagnetisation of the permanent magnet.

* * * * *